US005137482A

United States Patent [19]

Hull et al.

[11] Patent Number: 5,137,482

[45] Date of Patent: Aug. 11, 1992

[54] FLUSHING DEVICE FOR INBOARD MOTORS

[76] Inventors: Harold L. Hull, 401 Canyon Way #43, Sparks, Nev. 89434; Peter L. Lyhne, P.O. Box 5424, Tahoe City, Calif. 95730

[21] Appl. No.: 737,419

[22] Filed: Jul. 29, 1991

[51] Int. Cl.[5] ..... B63H 21/10; B63H 21/38; B63B 59/00

[52] U.S. Cl. ..... 440/88; 440/113; 440/900; 114/222; 114/198; 92/165 R; 134/167 R

[58] Field of Search ..... 440/88, 113, 900; 114/198, 222; 92/165 R; 134/167 R, 166 R

[56] References Cited

U.S. PATENT DOCUMENTS 3,002,488 10/1961 Guhlin ..... 440/113
3,347,202 10/1967 McCurry ..... 440/113
3,878,807 4/1975 Reskusic et al. ..... 114/198
3,886,889 6/1975 Burger ..... 115/5 R
4,246,863 1/1981 Reese ..... 440/88
4,481,867 11/1984 Nagase et al. ..... 91/487
4,540,009 9/1985 Karls ..... 134/167 R
4,773,831 9/1988 Brauer et al. ..... 417/387
4,838,864 6/1989 Peterson ..... 604/100
4,976,192 12/1990 Grach ..... 92/165 R

*Primary Examiner*—Joseph F. Peters, Jr.
*Assistant Examiner*—Kenneth Lee

[57] ABSTRACT

A flushing device for supplying water to the cooling intake port of an inboard motor boat propulsion unit when the boat is out of the water and which has a suction cup adapted to cover the intake port and supported from the ground by a telescoping handle and provides a hose bib in communication with a garden hose.

7 Claims, 1 Drawing Sheet

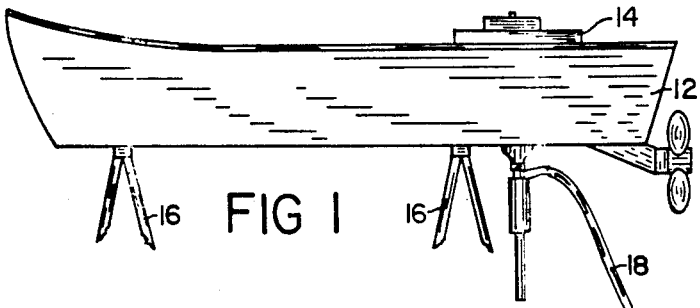
FIG 1
FIG 4
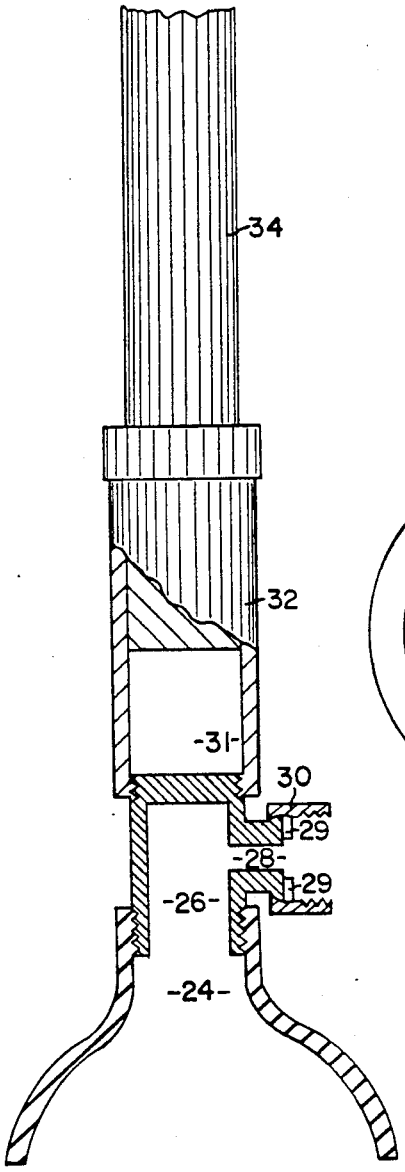
FIG 2
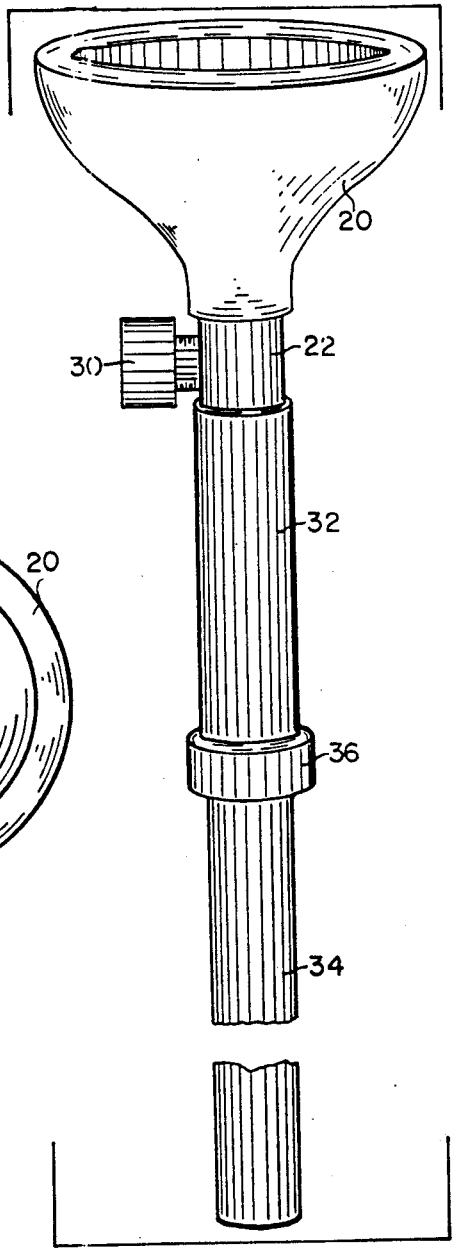
FIG 3
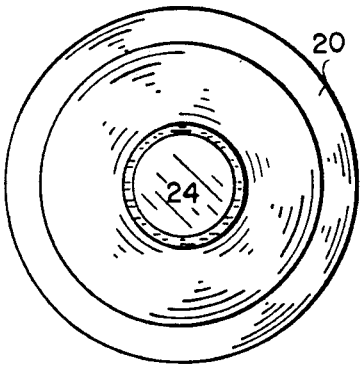

FLUSHING DEVICE FOR INBOARD MOTORS

FIELD OF THE INVENTION

This invention relates to flushing devices for marine propulsion units and more particularly to a device adapted to be attached to the water intake port of an inboard propulsion unit when the unit is out of the water and means to supply water to the water intake port.

BACKGROUND OF THE INVENTION

Flushing devices are used to supply water to the water intake ports of outboard motors and stern drives to clear the internal passages of the motors or to provide coolant to allow the motors to be run while they are out of the water. Exemplary of such devices are the flushing deices of U.S. Pat. No. 4,540,009 to Karls on Sep. 10, 1985 and U.S. Pat. No. 3,886,889 to Burger on Jun. 3, 1975. The Karls device uses double suction cups which has a clamping device, while the Burger device uses a water impervious sack affixed to a rigid frame member. These device are adapted to be used for outboard motors and are not suitable for inboard motors with their water intake ports on the bottom of the boat.

SUMMARY OF THE INVENTION

It is a primary object of the present invention to provide a simple means to supply fresh water to the water intake port of an inboard motor.

It is a further object to provide a device to fit over the water intake port of an inboard motor and provide means to hold the device in a water tight relationship with the intake port and the boat.

Yet another object is to provide a support means for the device which does not attach to the boat structure but is supported by contact with the ground surface.

Still another object is to provide support means which is adjustable in height.

Another important object is to provide attachment means on the device for a water hose.

It is a further object to make the device portable and inexpensive to manufacture.

Further objects and advantages will become apparent when taken in consideration with the following specifications and drawings:

BRIEF DESCRIPTION OF THE DRAWINGS

FIG. 1 is plan view of the device affixed over the water intake port of a typical boat supported by support members.

FIG. 2 is a perspective view of the device.

FIG. 3 is an end view of the device.

FIG. 4 is a partial cut-a-way view showing the interior of the device.

DETAILED DESCRIPTION OF THE DRAWINGS

Referring now in detail to the drawings wherein like characters refer to like elements, 10 is a general view of the device affixed over the intake port (not shown) of a typical boat 12 with an inboard motor 14 and being supported above the ground by support members 16 with a garden hose 18 affixed to the device.

20 is a suction cup or the like adapted to be attached to a T member 22 and communicating internally through chamber 24 with internal chamber 26 of T member 22 and internal chamber 28, with 30 being a hose bib cooperating with garden hose 18, while 29 is a washer.

The T member 22 is closed at 31 on its handle end to block water passage, while 32 is a tubular section with one of its ends having means to attach to the closed end 31 and its distal end being in slideable communication with tubular handle section 34 and having ring 36 which is threadably engaged (threads not shown) to section 32 and when tightened on a split collet (not shown) provides a locking relationship between handle 34 and section 32, thus providing multiple telescopic locking positions to provide variable heights to support the device between the boat 12 and the ground support.

The handle 34, section 32, T 22 and ring 36 may be made of plastic while the suction cup is made of a flexible material such as rubber to provide a compressed, water tight seal against the boat when forced against the boat over the intake port and held in a tensioned position by locking ring 36.

It will now be seen that we have provided a simple yet effective device for bringing fresh water to the intake port of an inboard motor and, with a telescopic locking handle, to be able to urge the suction cup over the intake port and cause the suction cup to seal against the boat, thus providing a water tight seal and when water under pressure is provided through a water hose, the water is forced through the motor for flushing and cooling.

Although the invention has been shown and described in what is conceived to be the most practical and preferred embodiment, it is recognized that departures may be made therefrom within the scope and sprit of the invention, which is not to be limited to the details disclosed herein but is to be accorded the full scope of the claims so as to embrace any and all equivalent devices and apparatus.

Having described our invention, what we claim as new and desire to secure by letters patent is:

1. A flushing device for supplying water to a cooling water intake port of an inboard motor boat propulsion unit comprising: a sealing element structured and adapted to cover said intake port of said inboard motor boat propulsion unit, said sealing element having a cavity in its interior, a tee, said tee having a hose bib on its lateral outlet, said tee having means on one of its ends to attach to said sealing element, a handle, said handle having at least first and second sections, said tee having means on its distal end to attach to said first handle section, said tee having a cavity communicating with said cavity said sealing element and said hose bib, said tee being sealed on its interior distal end, said first and second handle sections having a telescoping relationship, and locking means between said first and second handle sections.

2. The device of claim 1 in which said sealing element is made of a resilient material.

3. The device of claim 1 in which said sealing element is a suction cup.

4. The device of claim 2 in which said resilient material is rubber.

5. The device of claim 1 in which said tee, said first and second handle sections and said locking means is made of plastic.

6. The device of claim 1 in which said means to attach said tee to said sealing element and said first section is by threading.

7. The device of claim 1 in which said locking means is a ring and split collet fitting.

* * * * *